US006854797B1

(12) United States Patent
Thomas

(10) Patent No.: US 6,854,797 B1
(45) Date of Patent: Feb. 15, 2005

(54) FOLDABLE BENCH

(76) Inventor: John S. Thomas, 612 W. Hargett St., Raleigh, NC (US) 27603

( * ) Notice: Subject to any disclaimer, the term of this patent is extended or adjusted under 35 U.S.C. 154(b) by 0 days.

(21) Appl. No.: 10/659,236

(22) Filed: Sep. 9, 2003

Related U.S. Application Data

(60) Provisional application No. 60/409,538, filed on Sep. 9, 2002.

(51) Int. Cl.[7] ..... A47C 4/00

(52) U.S. Cl. ..... 297/16.1; 297/16.2; 297/25; 297/42; 297/51; 297/53; 297/54

(58) Field of Search ..... 297/16.1, 16.2, 297/24, 25, 42, 43, 51, 53, 54

(56) References Cited

U.S. PATENT DOCUMENTS

| | | | | | |
|---|---|---|---|---|---|
| 191,015 | A | * | 5/1877 | Webb | 297/53 |
| 245,903 | A | * | 8/1881 | White | 297/54 X |
| 346,454 | A | * | 8/1886 | Baldwin | 297/54 X |
| 383,255 | A | * | 5/1888 | Spaet et al. | 297/54 |
| 1,531,837 | A | * | 3/1925 | Boldin | 297/53 X |
| 1,952,610 | A | * | 3/1934 | Gladstone | 297/25 X |
| 2,067,101 | A | * | 1/1937 | Shaw | 297/25 X |
| 2,073,155 | A | * | 3/1937 | Gladstone | 297/25 X |
| 2,417,439 | A | * | 3/1947 | Overdick | 297/25 |
| 2,483,309 | A | * | 9/1949 | Amaducci | 297/54 |
| 2,566,818 | A | * | 9/1951 | Babit | 297/53 X |
| 2,887,149 | A | * | 5/1959 | Cassin | 297/25 |
| 3,822,913 | A | * | 7/1974 | Raver | 297/25 |
| 4,034,684 | A | | 7/1977 | Carson et al. | |
| 4,061,305 | A | | 12/1977 | Beckenkamp | |
| 4,245,849 | A | * | 1/1981 | Thiboutot | 297/16.2 X |
| 4,278,243 | A | | 7/1981 | Alessio | |
| 4,406,495 | A | | 9/1983 | Turner | |
| 4,617,869 | A | * | 10/1986 | Denomey | 297/42 X |
| 4,699,422 | A | * | 10/1987 | Yamasaki | 297/25 X |
| 4,960,277 | A | | 10/1990 | LaRossa et al. | |
| 5,058,948 | A | * | 10/1991 | Singer | 297/25 X |
| 5,058,950 | A | * | 10/1991 | Mann | 297/45 |
| 5,080,024 | A | | 1/1992 | Yamamoto | |
| 5,394,810 | A | | 3/1995 | Howard et al. | |
| 5,882,283 | A | | 3/1999 | Stevens | |
| 5,908,182 | A | | 6/1999 | Stang et al. | |
| 5,993,360 | A | | 11/1999 | Stevens | |
| 6,161,486 | A | | 12/2000 | Boots | |
| 6,182,724 | B1 | | 2/2001 | Chou et al. | |
| 6,254,177 | B1 | * | 7/2001 | Tseng | 297/54 |
| 6,264,586 | B1 | | 7/2001 | Webber | |
| 6,299,251 | B1 | | 10/2001 | Harper | 297/604 |
| 6,340,205 | B1 | | 1/2002 | Battiston | 297/24 |
| 6,550,855 | B2 | * | 4/2003 | Liu | 297/42 |
| 2003/0020305 | A1 | * | 1/2003 | Liu | 297/42 |

FOREIGN PATENT DOCUMENTS

| | | | | | |
|---|---|---|---|---|---|
| CH | 683311 | A5 | * | 2/1994 | 297/16.2 |
| EP | 52031 | A1 | * | 5/1982 | 297/16.2 |
| GB | 2074853 | A | * | 11/1981 | 297/16.2 |
| GB | 2192534 | A | * | 1/1988 | 297/51 |

* cited by examiner

*Primary Examiner*—Rodney B. White
(74) *Attorney, Agent, or Firm*—Coats & Bennett, P.L.L.C.

(57) ABSTRACT

A foldable bench having at least a pair of seat sections pivotally connected together. Pivotally mounted to the other side of each seat section is a leg assembly that is movable from a folded position to an extended position. When the bench assumes an unfolded position a strut extends from a point to a respective leg assembly and when the bench carries a load each strut is held in compression. An interconnecting member connects the two leg assemblies and is generally held in tension when the bench assumes an unfolded position and carries a load.

19 Claims, 5 Drawing Sheets

FOLDABLE BENCH

RELATED APPLICATIONS

This application claims priority under 35 U.S.C. § 119(e) from the following U.S. provisional application: Application Ser. No. 60/409,538 filed on Sep. 9, 2002. That application is incorporated in its entirety by reference herein.

BACKGROUND OF THE INVENTION

Athletic benches are widely used in a variety of sports ranging from football to soccer. Usually, athletic benches, or benches occupied by players during the course of an athletic contest, come in different sizes and designs. Many such benches are made of wood or metal. However, most athletic or player benches share one common characteristic. They are usually large and far from portable. Such conventional player benches are generally functional. But their size and weight restrict their use to essentially one location.

Certain athletic fields such as soccer fields or baseball fields typically used by children or young adults are not provided with player benches. Thus, those players not actually participating usually stand or kneel on the sidelines. This is not an ideal situation, especially for players taking a break from the athletic action.

Therefore, there has been and continues to be a need for a foldable bench that can be folded and carried from on location to another.

SUMMARY OF THE INVENTION

The present invention entails a foldable bench having at least two seat sections and an underlying support structure. The underlying support structure includes at least two leg assemblies that are foldable from a folded or retracted position to an extended position. In the extended position the leg assemblies are interconnected by a pair of connectors. Further, the leg assemblies are interconnected by a cable or other interconnecting member.

In one preferred embodiment, when the foldable bench assumes an erect and unfolded position, the connectors extending between the bench and the leg assemblies are maintained in compression while the cable or interconnecting member extended between the leg assemblies is maintained in tension.

Other objects and advantages of the present invention will become apparent and obvious from a study of the following description and the accompanying drawings which are merely illustrative of such invention.

DESCRIPTION OF THE INVENTION

Figure 1:
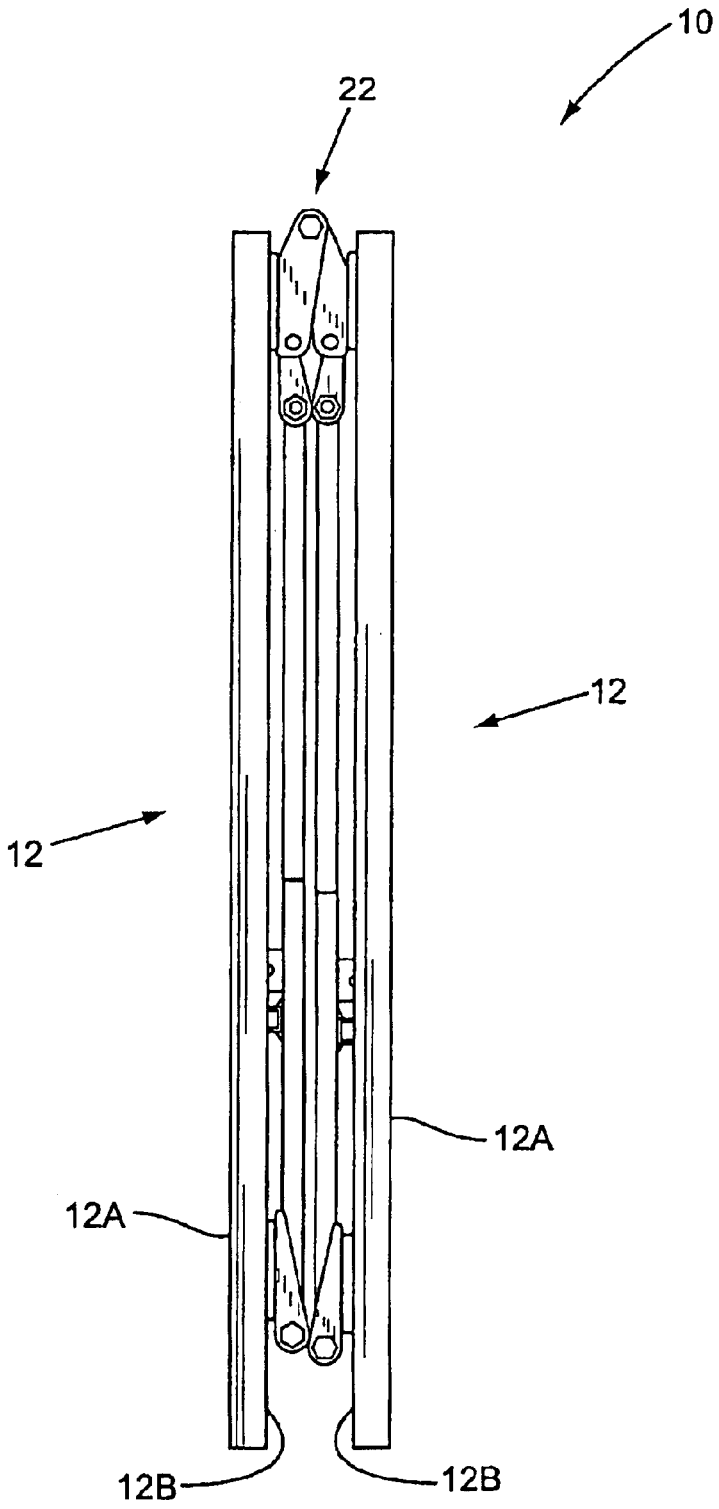
FIG. 1 is a side elevational view of the foldable bench shown in a folded position.

With further reference to the drawings, the foldable bench of the present invention is shown therein and indicated generally by the numeral 10. As will be appreciated from subsequent portions of this disclosure, the foldable bench 10 is adapted to assume a folded position, as shown in FIG. 1, or an unfolded or erect position as shown in FIG. 2.

Viewing the foldable bench 10 in more detail, the same includes a pair of seat sections, each seat section being indicated generally by the numeral 12. It should be appreciated that the foldable bench 10 could include any number of seat sections 12 but in the case of the embodiment illustrated herein, the foldable bench includes two seat sections. Each seat section includes a top 12A and a bottom 12B. Seat sections 12, and other portions of the foldable bench 10, can be constructed of various materials such as plastic, wood, metal, fiberglass, etc.

Figure 2:
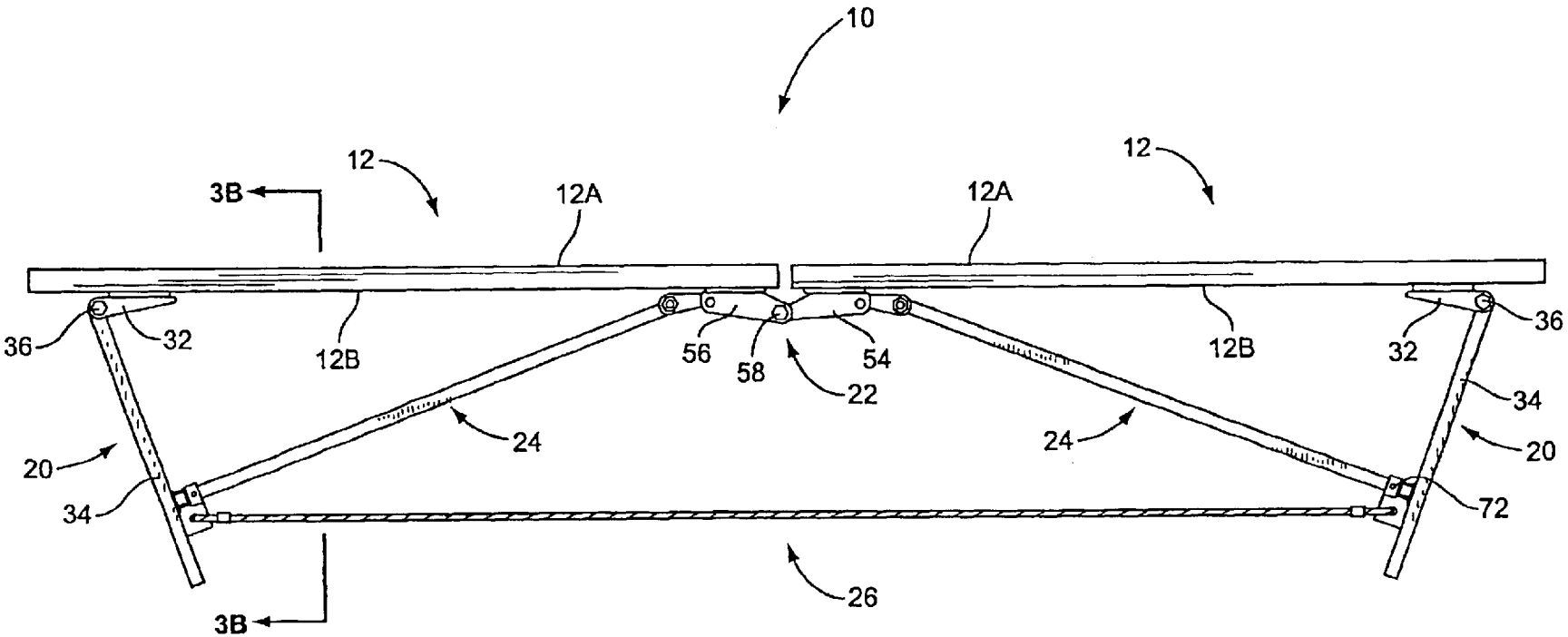
FIG. 2 is a side elevational view of the foldable bench shown in an unfolded and erect position.
Figure 3A:
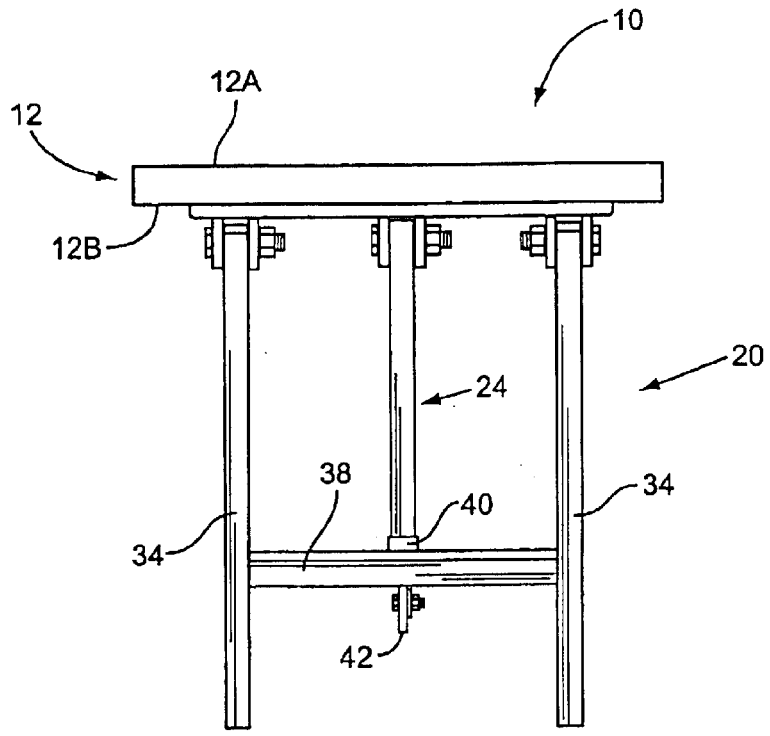
FIG. 3A is an end elevational view of the bench.
Figure 3B:
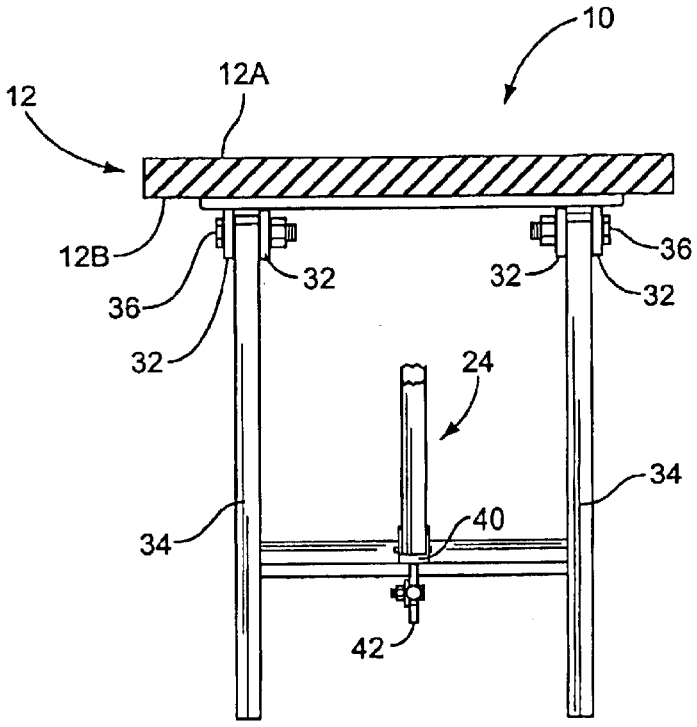
FIG. 3B is a sectional view of the lines 3B—3B of FIG. 2.

To support the foldable bench 10 when the same assumes the unfolded or erect position shown in FIG. 2, there is provided an underlying support structure. This underlying support structure includes a pair of leg assemblies of 20, each leg assembly being foldable and mounted to the underside 12B about the outboard portion of each seat section 12. Connected between the inboard portions of the seat sections 12 is a hinge assembly 22. As will be appreciated from subsequent portions of the disclosure, the hinge assembly 22 permits the seat sections to be folded back-to-back as shown in FIG. 1 or to be extended to where the seat sections lie end-to-end and generally within the same plane. A strut or first connector indicated generally by the numeral 24 is connected between each leg assembly 20 and the hinge assembly 22. As will be appreciated subsequent herein, when the foldable bench 10 is unfolded and assumes the erect position of FIG. 2, the individual connectors 24 are in compression when a load is applied to the erected bench 10. In addition, a cable or interconnecting member 26 is connected between the leg assemblies 20. In a preferred embodiment, the interconnecting member assumes the form of a flexible cable 26. However, it is appreciated that the interconnecting member 26 could simply be a rigid rod, shaft or even a telescoping member.

With reference to FIGS. 3A–4B, the leg assembly 20 is shown in more detail therein. Each leg assembly mounted to the outboard end of a seat section 12 includes a bracket or mounting plate 30 that is secured to the underside of a respective seat section by bolts, screws or other suitable means. Formed on each side of the bracket is pair of spaced apart gussets 32. A leg 34 is pivotally mounted between each pair of gussets 32 by a pivot pin 36. In the case of the present embodiment, pivot pin 36 assumes the form of a bolt and nut assembly. Extending across and between the legs 34 is a cross member 38. Secured or formed on the inside of the cross member 34 is a stub sleeve 40 that as will be understood later, functions to connect to one end of the connectors 24. Extending from the central portion of the cross member 38 is a tab 42 that is adapted to connect to one end of the cable 26.

Figure 4A:
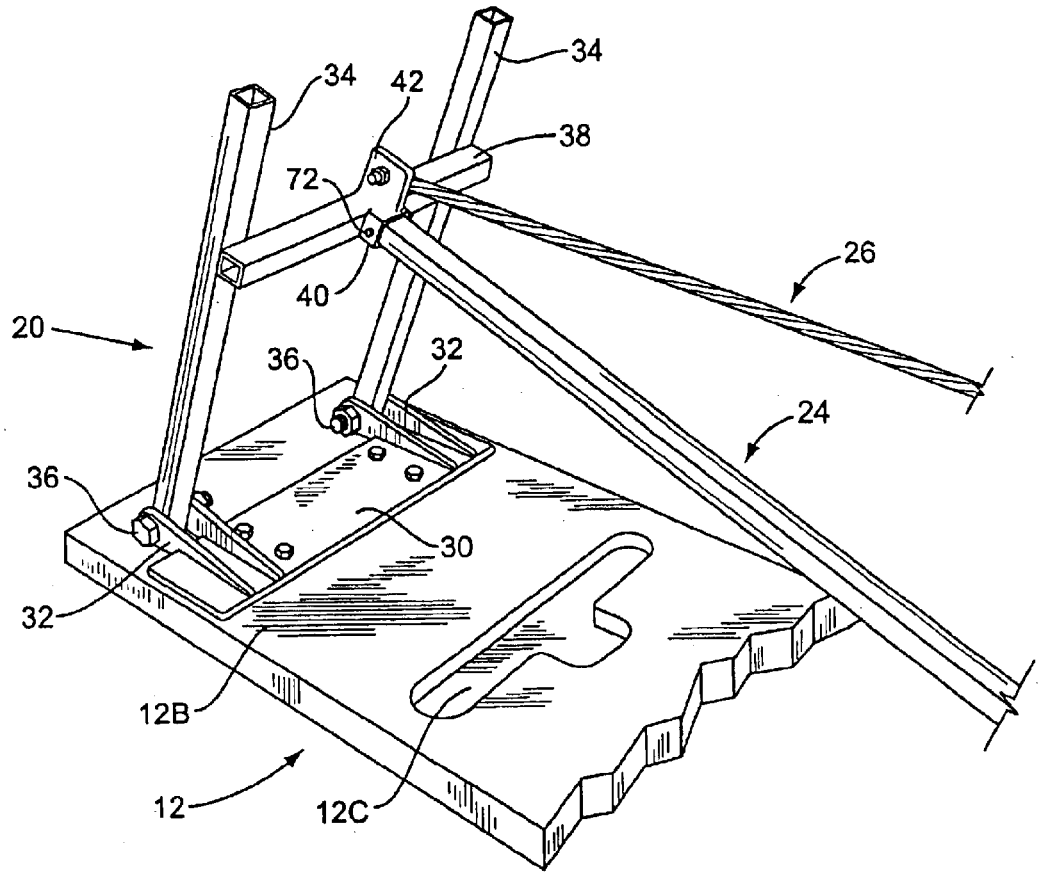
FIG. 4A is a fragmentary perspective view showing the underside of a portion of a foldable bench in an erect posture.
Figure 4B:
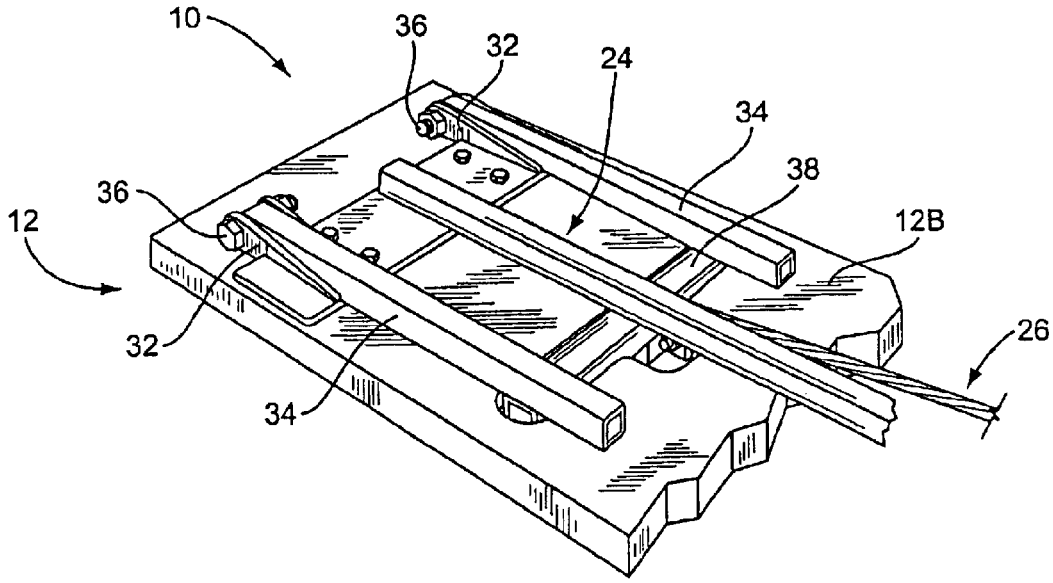
FIG. 4B is a fragmentary perspective view of a portion of the foldable bench shown in a folded position.

As seen in FIGS. 4A and 4B, the entire leg assembly 20 can be pivoted via the pivot pins 36 from an extended position (FIG. 4A) and a retracted or folded position (FIG. 4B).

Figure 5:
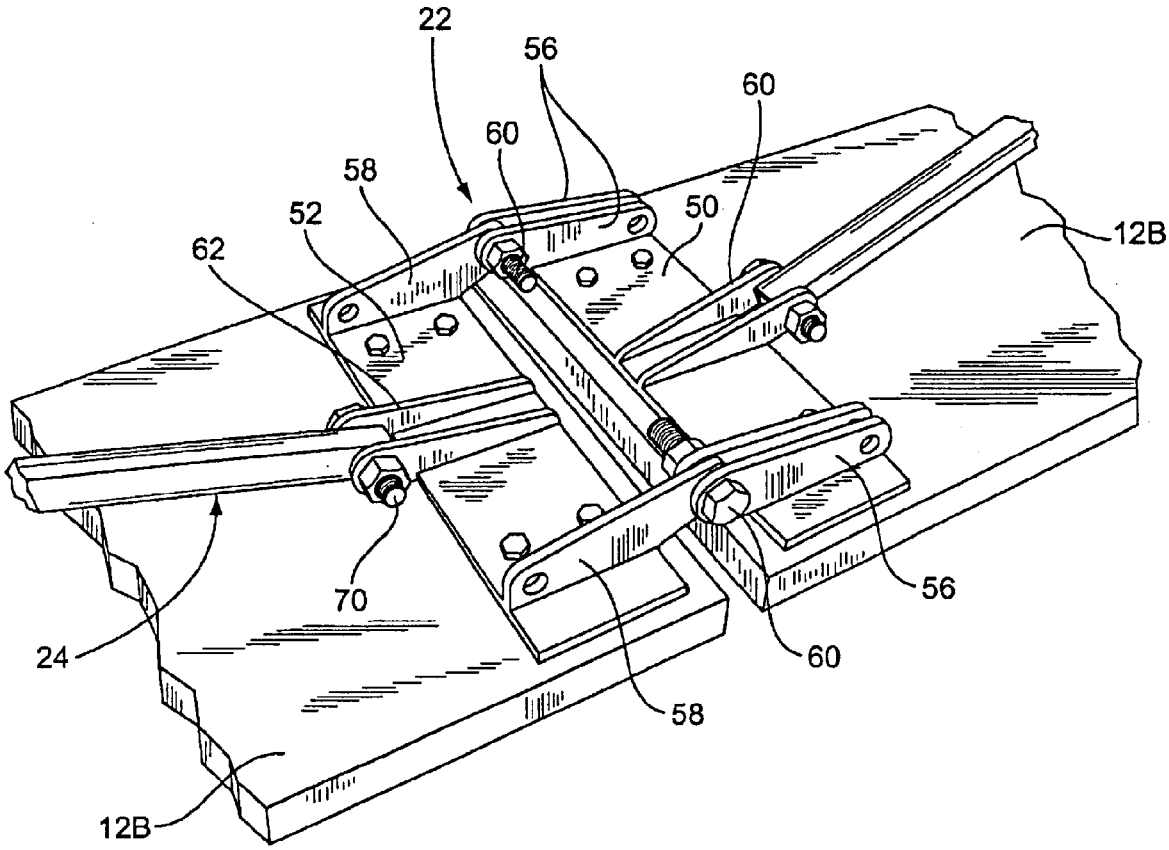
FIG. 5 is a perspective view of an underside portion of the foldable bench illustrating the hinge structure interconnecting two seat sections.

With specific reference to FIGS. 2 and 5, the hinge 22 for connecting the seat sections 12 is shown. Hinge 22 includes a pair of brackets 50 and 52, each bracket being secured to the underside 12B of a respective seat section about an inboard end. One of the brackets, in this case, bracket 50 includes two sets of hinge fingers, with each hinge finger being referred to by the numeral 56. On the other bracket 52, there is provided a pair of spaced apart hinge fingers 58. A seen in FIG. 5, the single hinge fingers 58 project into and between a pair of the hinge fingers 56 formed on the opposite bracket 50. All of the hinge fingers 56 and 58 includes openings for receiving a pivot pin 60. In this case, each pivot pin 60 includes a bolt and nut assembly.

Therefore, it is seen that the seat sections 12 can be pivoted about the axis of the two pivot pins 60. In one configuration, the foldable bench assumes a folded position (FIG. 1), and in another configuration the bench sections 12 assume an extended position and wherein, as viewed in FIG. 2, the hinge assembly 22 also is extended.

Finally, each of the brackets 50 and 52 of the hinge assembly include a pair of connector gussets 62. As seen in FIG. 5, each pair or set of connector gussets 62 is generally centrally located with each gusset including an opening formed in the outer terminal end.

Pivotally connected to the connector gussets 66 is the connector 24. A pivot pin 70 in the form of a bolt and nut assembly is extended through the openings within the terminal ends of the gussets 62 and through an opening in one end portion of the connector 24. The other end of the connector 24 is adapted to be inserted into the stub sleeve 40 of one of the leg assemblies 20. This is particularly illustrated in FIG. 4A. When the foldable bench 10 assumes the unfolded or erect position, it is desirable to lock or secure each connector 24 to a respective leg assembly 20. Therefore, there is provided a locking pin or screw 72 that is adapted to be secured to both the outer end of each connector 24 and a respective stub sleeve 40. The locking pins or screws 72 can be easily and quickly attached and detached to facilitate the folding of the bench 10.

Further, the leg assemblies 20, in an erect position, are interconnected by a cable 26. It is noted that the cable 26 is secured to the leg 20 by connecting to the tabs 42 extending from the cross member 38. Cable 26 can be connected to the tabs in various ways. For example, the opposed terminals ends of the cable 26 can be secured to a bolt assembly which is in turn connected to an opening formed in the tab 42.

In the folded position, as seen in FIGS. 1 and 4B, the leg assemblies 20 are rotated to where the legs 34 point towards the hinge assembly 22. The underside of each seat section 12 includes a recess or cavity 12C that receives a portion of the leg assembly 24. In the case of the embodiment illustrated herein, the recess or cut-out 12C is particularly adapted to receive at least a portion of the cross member 38 and the stub sleeve 40 and tab 42 that are associated with the cross member 38. This tends to make the bench 10 more compact when the same assumes the folded position.

When the bench 10 is extended to its erect position shown in FIG. 2, it is appreciated that the length of the connectors 24 and the cable 26 is calculated so as to result in the legs of the leg assemblies being directed inwardly at an angle. That is, in the preferred embodiment, the leg assemblies 20 and particularly the legs 34 thereof are not disposed perpendicular to the seat sections 12 but are disposed at an angle as illustrated in FIG. 2. While this angle may vary, in one exemplary configuration, the legs 34 form an angle of approximately 20 degrees with respect to a reference line that extends through the pivot pins 36 and normal to the seat sections 12. It is contemplated that the angle of the legs 34 with respect to the reference line could vary from 10 to 20 degrees. Further, each strut or connector 24 would preferably extend generally normal to the attached leg assembly 20. That is, each strut or connector 24 would form a generally right angle with respect to the leg assembly 20.

Further, when the foldable bench 10 is disposed in the erect position shown in FIG. 2, and a load is placed on the bench 10, the connectors 24 are generally held in compression. Cable 26, on the other hand, is maintained in tension and thus prevents the legs from rotating outwardly in response to a load being placed on the bench.

Finally, the folded bench 10 may assume various configurations and designs. In one particular embodiment, the interconnecting member 26, as discussed above, could be in the form of a cable and the cable could be utilized as a carrying strap for the entire bench 10 when the same assumes the folded configuration. Additionally, in the embodiments illustrated herein, the bench is shown as including two seat sections 12. However, it will be appreciated that the foldable bench 10 could include more than two foldable sections.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A foldable bench comprising:

a. at least two seat sections wherein the seat sections are movable between an extended position and a folded position;

b. at least two legs that are mounted to each respective seat section and movable between a foldable position and an extended position;

c. a pair of first connectors connecting the respective seat sections to the respective legs when the seat sections assume an extended position;

d. wherein when the bench supports a load when in the extended position, the first connectors are in compression, e. a second connector for connecting the two legs when the two legs assume an extended position; and f. wherein when the bench supports a load when in the extended position and the second connector is connected between the two legs, the second connector is in tension.

2. The foldable bench of claim 1 wherein the second connector is a cable.

3. The foldable bench of claim 2 wherein the first connectors extend generally diagonally with respect to the seat sections when the seat sections assume the extended position.

4. The foldable bench of claim 1 wherein when the seat sections assume the extended position and the foldable bench assumes an unfolded position, each first connector extends from a position underneath an intermediate area of the bench outwardly and downwardly to where an end portion of the connector connects to a respective leg.

5. The foldable bench of claim 4 wherein the second connector comprises a cable that when the legs are extended and the bench assumes an unfolded position, the cable extends between the legs.

6. The foldable bench of claim 1 wherein each leg forms a part of a leg assembly and wherein each leg assembly is foldably mounted to an underside of each seat section about an outer end portion of the seat section.

7. The foldable bench of claim 6 wherein each leg assembly is pivotally mounted to a respective seat section and wherein when the bench assumes a folded position, the leg assemblies assume a folded position adjacent a respective seat section and wherein the two leg assemblies are disposed in back-to-back relationship to each other.

8. The foldable bench of claim 1 wherein there is provided a hinge for pivotally connecting the two seat sections together.

9. The foldable bench of claim 8 wherein each of the first connectors extends from the hinge.

10. The foldable bench of claim 8 wherein each first connector includes an end portion that is connected to the hinge and wherein each connector, when the bench assumes the unfolded or erect position, extends generally outwardly and downwardly from the hinge to where an outer end portion of the connector connects to a respective leg.

11. A foldable bench movable between a folded position and an erect position, comprising: a pair of seat sections wherein the seat sections are movable between a folded position and an extended position, a pair of foldable legs, each leg adapted to extend from one seat section and movable from a folded position to an erect position; wherein when the bench assumes the erect position, the legs assume the extended position but are inclined at least slightly inwardly such that each leg extends downwardly and inwardly from a respective seat section; a strut connected between each leg and a respective seat section when the bench is in the erect position, each strut is held in compression when the bench supports a load when in the erect position; and an interconnecting member interconnected between the two legs such that when the bench is in the erect position and supporting a load, the interconnecting member is held in tension.

12. The foldable bench of claim 11 wherein there is provided a hinge for connecting the two sections together and wherein each strut is connected to the hinge and when the foldable bench assumes the erect position, each strut projects from the hinge towards one leg.

13. The foldable bench of claim 11 wherein when the foldable bench assumes the folded position the two seat section extends generally parallel and the two legs assume the folded position and lie back to back such that the two legs are generally sandwiched between the two seat sections.

14. The foldable bench of claim 11 wherein the interconnecting member held in tension is a cable.

15. The foldable bench of claim 11 wherein each leg forms a part of a leg assembly wherein each leg assembly includes a pair of legs and a transverse member interconnected between the legs.

16. A method of unfolding and erecting a foldable bench having at least two seat sections, comprising:

a. moving the seat sections from a folded position to an unfolded position b. moving a pair of legs from a folded position to an unfolded position;

c. stationing the legs in an unfolded position by connecting a strut to each leg and extending the strut towards a respective seat section;

d. in response to a load being placed on the bench when the bench is in the unfolded position, the struts are in compression; and e. interconnecting the legs with an interconnecting member and maintaining the interconnecting member in tension when the bench carries a load when in the unfolded position.

17. The method of claim 16 wherein the legs are maintained in a position where they extend at least slightly inwardly when the bench assumes the unfolded position.

18. The method of claim 16 including pivotally connecting the two seat sections together with a hinge and connecting at least one end of each strut with the hinge when the bench assumes the unfolded position.

19. The method of claim 16 including returning the bench to a folded position by folding the legs to a position adjacent the seat sections and folding the seat sections together such that the legs are sandwiched between the seat sections.

* * * * *